US007000906B2

(12) United States Patent
Geyer et al.

(10) Patent No.: US 7,000,906 B2
(45) Date of Patent: Feb. 21, 2006

(54) CARBURETOR

(75) Inventors: Klaus Geyer, Sulzbach (DE); Arno Kinnen, Fellbach (DE); Jan Borchardt, Grimmen (DE); Reinhard Gerhardy, Korb (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/871,058

(22) Filed: Jun. 21, 2004

(65) Prior Publication Data

US 2004/0256744 A1 Dec. 23, 2004

(30) Foreign Application Priority Data

Jun. 20, 2003 (DE) ..... 103 27 905

(51) Int. Cl.
*F02M 7/08* (2006.01)

(52) U.S. Cl. ..... 261/34.2; 261/35; 261/51; 261/DIG. 37

(58) Field of Classification Search ..... 123/426, 123/437; 261/34.2, 35, 51, 70, 71, 72.1, 261/DIG. 8, DIG. 67, DIG. 68, DIG. 37, 261/DIG. 38
See application file for complete search history.

(56) References Cited

U.S. PATENT DOCUMENTS

| | | | | |
|---|---|---|---|---|
| 3,882,204 A * | 5/1975 | St. Amand | ..... | 261/34.2 |
| 4,440,697 A * | 4/1984 | Sakurai | ..... | 261/34.2 |
| 5,250,233 A | 10/1993 | Swanson | ..... | 261/34.2 |
| 5,554,322 A * | 9/1996 | Kobayashi | ..... | 261/35 |
| 6,293,524 B1 * | 9/2001 | Endo et al. | ..... | 261/34.2 |

FOREIGN PATENT DOCUMENTS

| | | | | |
|---|---|---|---|---|
| JP | 60150464 A * | 8/1985 | ..... | 261/34.2 |

* cited by examiner

*Primary Examiner*—Willis R. Wolfe, Jr.
(74) *Attorney, Agent, or Firm*—Walter Ottesen

(57) ABSTRACT

A carburetor for an internal combustion engine includes an intake channel section (2) as well as a throttle element journalled in the intake channel section (2). The throttle element is adjustable between a full-load position (25) and an idle position (26). A pump (20, 30) is provided for additional fuel metering and this pump includes a pumping chamber (24, 34) and a pump piston (21, 31) guided in the pumping chamber (24, 34). The position of the pump piston (21, 31) is coupled to the position of the throttle element. To ensure an optimal supply of the internal combustion engine with fuel in each operating state, the pump piston (21, 31) is so coupled to the throttle element that fuel is pumped from the pumping chamber (24, 34) into the intake channel section (2) when there is a displacement of the throttle element from the full throttle position (25) into the idle position (26).

17 Claims, 4 Drawing Sheets

CARBURETOR

CROSS REFERENCE TO RELATED APPLICATION

This application claims priority of German patent application No. 103 27 905.9, filed Jun. 20, 2003, the entire content of which is incorporated herein by reference.

FIELD OF THE INVENTION

The invention relates to a carburetor for an internal combustion engine, especially in a portable handheld work apparatus such as a motor-driven chain saw, cutoff machine or the like.

BACKGROUND OF THE INVENTION

U.S. Pat. No. 5,250,233 discloses a carburetor having an accelerator pump. The pump has a pump piston which is coupled to the position of the throttle shaft. When the throttle flap is displaced from the idle position into the full-load position, the pump piston executes a pump movement and conducts additional fuel to the intake channel. In this way, a leaning of the mixture when accelerating is intended to be avoided. During the transition from the full-load position of the throttle flap into the idle position, it can occur that the internal combustion engine does not drop immediately to the adjusted idle rpm; rather, the engine still stays at the higher rpm for some time.

SUMMARY OF THE INVENTION

It is an object of the invention to provide a carburetor which supplies the internal combustion engine with a good air/fuel mixture in each operating state.

The carburetor of the invention is for an internal combustion engine including an engine mounted on a portable handheld work apparatus. The carburetor includes: a carburetor housing defining an intake channel communicating with the engine; a throttle element journalled in the intake channel and being adjustable between a full-load position and an idle position; a pump assembly for supplying additional fuel for the engine; the pump assembly including a pump chamber and a pump piston guided in the pump chamber; and, means for coupling the position of the pump piston to the position of the throttle element so as to cause fuel to be pumped out of the pump chamber and supplied to the engine when the throttle element is shifted from the full-load position into the idle position.

The additional supply of fuel with a shift of the throttle element from the full-load position into the idle position prevents that the engine remains at a higher rpm and causes the idle rpm to be reached immediately because the mixture, which is made available, is sufficiently rich for this operating state. In this way, a good operating performance of the engine and a good response to a shift of the throttle element by the operator is obtained.

A simple configuration is provided when the pump piston lies against a control section of the throttle element. The control section is arranged especially outside of the intake channel section and includes at least one control flank. The control flank can be simply configured as a wall of a slot or the like. The throttle element has a first control flank which is in contact with the pump piston in a component region between the idle position and a position of the throttle element wherein the throttle element is shifted from the idle position up to 65% (especially, up to 40%) of the total displacement path to the full-load position. The throttle element especially has a second control flank which is in contact with the pump piston in a component range between the full-load position and a position of the throttle element wherein the throttle element is shifted from the full-load position up to 65% (especially, up to 40%) of the total displacement path up to the idle position. The throttle element has especially two control flanks so that the pump piston executes a back and forth movement with a movement of the throttle element from the idle position into the full-load position or vice versa. In each case, fuel is supplied to the intake channel section from the pumping space and the pumping space is again filled with the return movement. Depending upon the arrangement of the control flanks, and starting from the full-load position, fuel is first injected and, thereafter, the pumping space is filled or, for a reverse orientation of the control flanks, first the pumping space is filled and then, at a later time point, fuel is injected into the intake channel. With a configuration of this kind, it is possible to combine an acceleration pump as well as a pump for supplying fuel when the rpm is reduced. With the actuation of the throttle element from the idle position into the full-load position, both control flanks are likewise passed over so that here too a reciprocating pump movement is executed and, depending upon the arrangement of the control flanks, the pump space is first filled and then fuel is injected or fuel is first injected and then the pump space is filled.

It can be advantageous that a range of 5% to 40% (especially, of approximately 20%) of the total displacement path is present between the first control flank and the second control flank wherein the control section effects no displacement of the pump piston. In this way, a time-dependent separation is obtained between the injection and the renewed filling of the pump space. A simple configuration of the pump is provided when the control flank is configured as a flattening which runs approximately parallel to the longitudinal center axis of the intake channel section at the full-load position of the throttle element. In this configuration, a separate acceleration pump can be provided.

It is practical to connect the pump chamber via a fuel line to a fuel supply. The fuel supply is especially the control chamber of the carburetor configured as a membrane carburetor. However, it can also be practical that the fuel line opens into a fuel supply outside of the control chamber of the carburetor configured as a membrane carburetor. To avoid that the fuel can flow back into the fuel supply when pumping fuel from the pumping chamber, it can be provided that a first check valve is mounted in the fuel line. Advantageously, the fuel is pumped from the pumping chamber into the intake channel section. The pump conducts fuel via an injection line to the intake channel section. It can, however, also be practical that a fuel opening opens into the intake channel section and the pump conducts fuel to the fuel opening via a feed line. It is practical to provide a second check valve in the line leading from the pump to the intake channel. The throttle element is especially a throttle flap pivotally supported in the intake channel section by a throttle shaft.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
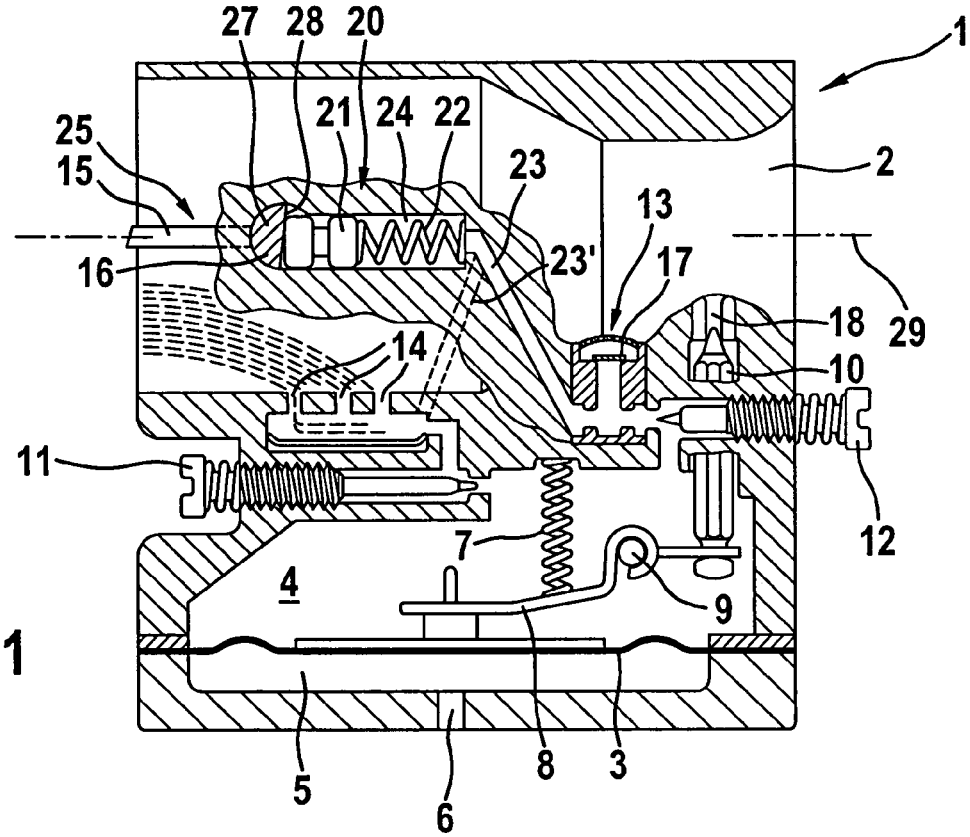
FIG. 1 is a schematic illustration of a carburetor in the full-load position.

FIG. 1 shows a view, partially in section, of a membrane carburetor 1 wherein an intake channel section 2 is formed. The membrane carburetor 1 functions to prepare an air/fuel mixture for the internal combustion engine in a portable handheld work apparatus such as a motor-driven chain saw, cutoff machine or the like. The membrane carburetor 1 has a control membrane 3 which separates a control chamber 4 from a compensation chamber 5. The compensation chamber 5 includes a compensation connection 6, for example, to connect to the air filter base of the work apparatus. The control chamber 4 is filled with fuel via a fuel feed line 18. An inlet needle 10 is mounted in the fuel feed line 18. The position of the inlet needle 10 is coupled to the position of the control membrane 3 via a lever 8 pivotally supported on a support 9. The lever 8 is spring biased by a spiral spring 7. The control chamber 4 supplies the idle inlet openings 14 as well as the main inlet opening 13 with fuel. The inlet openings (13, 14) open into the intake channel section 2. The main inlet opening 13 opens into the intake channel section 2 via a check valve 17. To adjust the fuel quantity, an idle set screw 11 as well as a primary set screw 12 are provided.

A throttle flap 15 having a throttle shaft 16 is pivotally journalled in the region of the idle inlet openings 14 in the intake channel section 2. In FIG. 1, the throttle flap 15 is shown in the full-load position 25. In this position, the throttle flap 15 extends approximately parallel to the longitudinal center axis 29 of the intake channel section 2. The longitudinal center axis 29 is the geometric center line of the intake channel section 2.

The membrane carburetor 1 has a pump 20 for supplying additional fuel into the intake channel section 2. The pump 20 is mounted outside of the intake channel section 2. The pump 20 includes a pump chamber 24 wherein a pump piston 21 is displaceably journalled against the force of a spring 22. The pump piston 21 lies against a control flank 28 of a control section 27 of the throttle shaft 16. The control flank 28 is configured as a flat which runs approximately transversely to the surface of the throttle flap 15 and, in the full-load position of the throttle flap 15, the control flank lies approximately transversely to the longitudinal center axis 29 of the intake channel section 2. The pump chamber 24 is connected to the main inlet opening 13 via a feed line 23. As shown in phantom outline in FIG. 1, the pump chamber 24 can also be connected to the idle inlet openings 14 via a feed line 23'.

Figure 2:
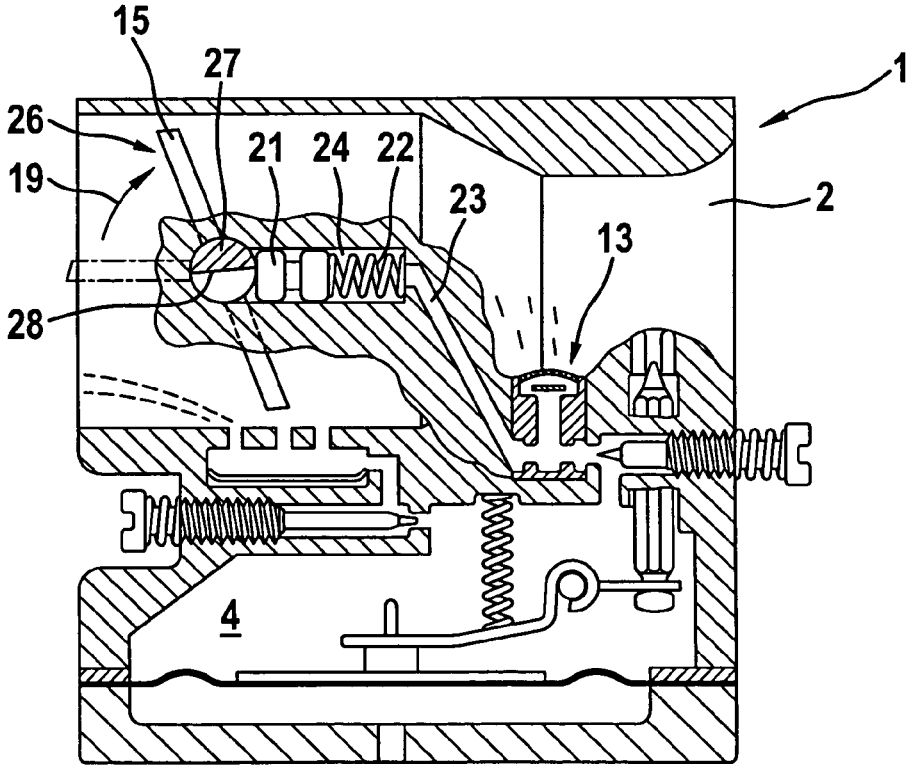
FIG. 2 is a schematic illustration of the carburetor of FIG. 1 in the idle position.

If, during the operation of the membrane carburetor, the throttle flap 15 is shifted in the direction of the arrow 19 shown in FIG. 2 into the idle position 26 of the throttle flap 15 shown in FIG. 2, then the control flank 28 presses the pump piston 21 against the force of the spring 22 in the direction toward the pump chamber 24. The fuel, which is stored in the pump chamber 24, is thereby supplied via the feed line 23 to the main inlet opening 13 or via the feed line 23' to the idle inlet openings 14 and from there to the intake channel section 2. With an abrupt closure of the throttle flap 15, additional fuel is thereby introduced into the intake channel section 2 and this additional fuel prevents a too intense leaning of the air/fuel mixture. For a rotation of the throttle flap 15 from the idle position 26 into the full-load position 25, the pump piston 21 is pressed by the spring 22 along the control flank 28 away from the pump chamber 24. This movement causes fuel to be drawn by suction from the control chamber 4 into the pump chamber 24 via a fuel line not shown in FIGS. 1 and 2.

Figure 3:
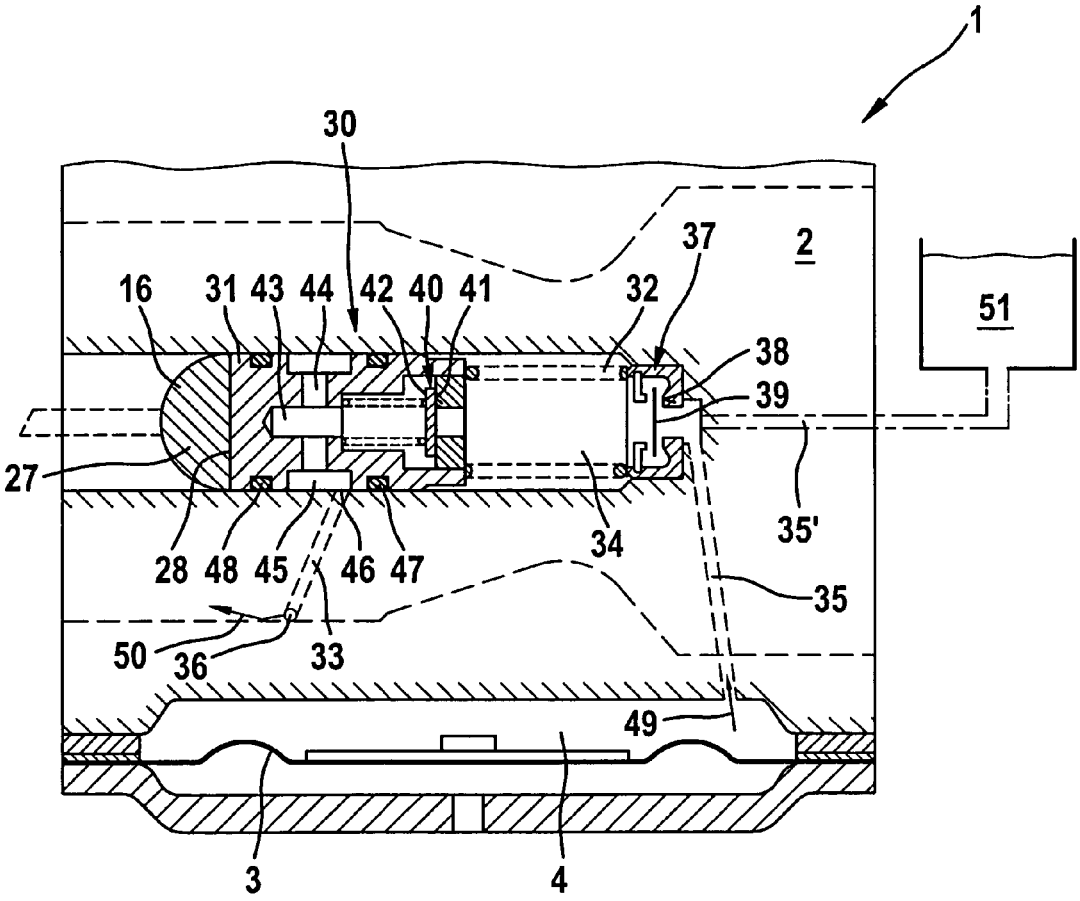
FIG. 3 is an enlarged view of a pump.

In FIG. 3, a pump 30 is shown in an enlarged scale and can be used in lieu of the pump 20 shown in FIGS. 1 and 2. The pump 30 includes a pump piston 31 which lies against the control flank 28 of the control section 27 of the throttle shaft 16. The pump piston 31 is pressed against the control flank 28 by a spring 32. The spring 32 is mounted in a pump chamber 34. The pump chamber 34 is connected to the control chamber 4 of the membrane carburetor 1 via a check valve 37 and the fuel line 35. The pump chamber 34 can, however, also be connected to a fuel supply 51 via a fuel line 35' shown in phantom outline in FIG. 3. The fuel supply 51 is not the control chamber 4. Fuel is inducted as indicated by arrow 49 through the fuel line 35 into the pump chamber 24 with a stroke of the pump piston 31 in the direction toward the throttle shaft 16. The valve plate 39 of the check valve 37 is lifted from the valve seat 38 and permits a flow of fuel in the direction of arrow 49. The check valve 40 arranged in the pump piston 31 is closed by the valve platelet 42, which lies on the valve seat 41, with a stroke of the pump piston 31 in the direction toward the throttle shaft 16.

For a movement of the pump piston 31 in the direction toward the pump chamber 34 (that is, for a rotation of the throttle flap from the full-load position into the idle position), the pressure in the pump chamber 34 is increased. In this way, the check valve 40 opens and fuel can flow from the pump chamber 34 via the blind bore 43, the transverse bore 44 and the annular slot 45 to the opening 46 and, from there, into the injection line 33. The blind bore 43 runs in the longitudinal direction of the pump piston and the annular slot 45 is arranged on the periphery of the pump piston 31. The fuel arrives in the intake channel section 2 via the injection line 33 and the injection opening 36. The fuel enters in the direction of arrow 50. To avoid leakages, the pump piston 31 has seals 47 and 48 on respective sides of the annular slot 45. These seals are preferably configured as O-rings held in annular slots.

Figure 4:
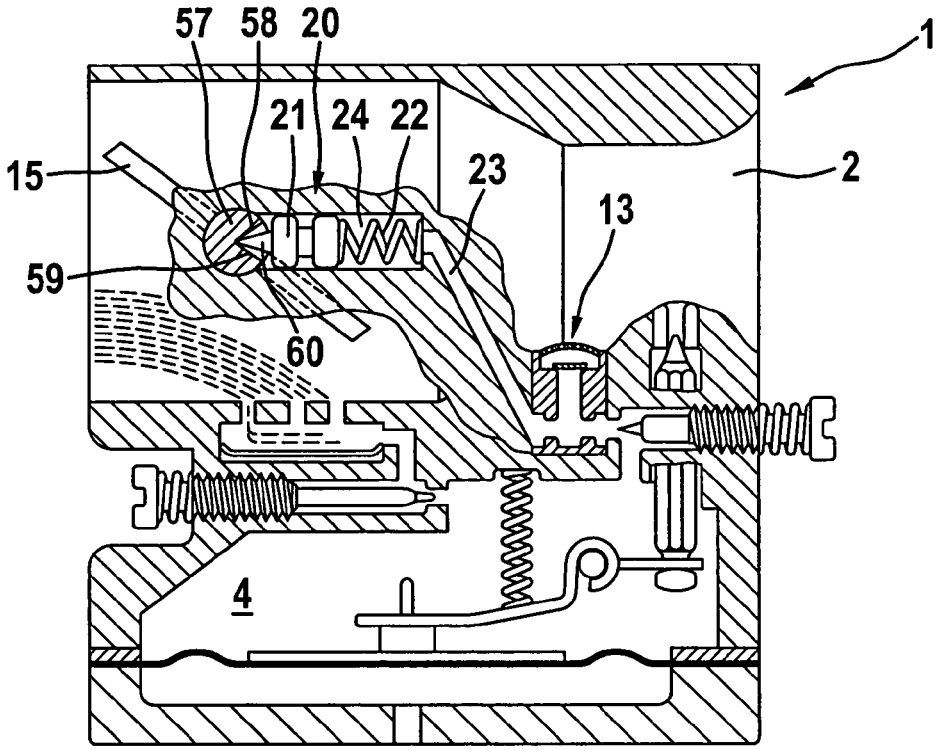
FIG. 4 is a schematic illustration of a carburetor according to another embodiment of the invention shown at half throttle position.
Figure 5:
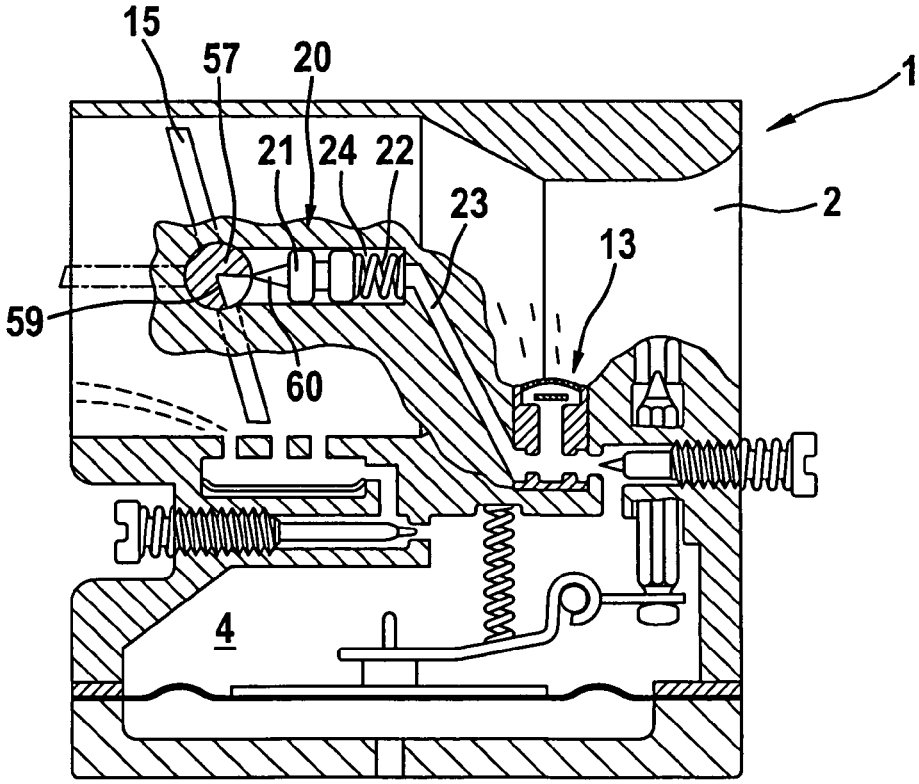
FIG. 5 is a schematic illustration of the carburetor of FIG. 4 shown in the idle position.

In FIGS. 4 and 5, an embodiment is shown for a control section 57. The additional components of the membrane carburetor 1, which is shown in FIGS. 4 and 5, correspond to those of the membrane carburetor shown in FIGS. 1 and 2. The same reference numerals identify the same components. The control section 57 has a circularly-shaped cross section wherein a V-shaped slot is introduced. The V-shaped slot extends over approximately 75° of the periphery of the control section 57. The extent of the slot on the periphery of the control section corresponds to approximately the rotational angle through which the throttle flap 15 passes between the idle position and the full-load position. The control section 57 includes a first control flank 58 and a second control flank 59. The control flanks 58 and 59 are configured to be symmetrical. The pump piston 21 has a contact tip 60 with which the pump piston is in contact with the control flanks 58 and 59.

For a rotation of the throttle flap 15 from the full-load position into the idle position, the contact tip 60 first comes into contact with the second control flank 59. The second control flank 59 extends over approximately 50% of the displacement path between the full-load position and the idle position. For a rotation of the throttle flap 15 from the full-load position into the idle position, the pump piston 21 is moved away from the pump chamber 24 by the spring 22 because of the control flank 59. In this way, fuel can be inducted into the pumping chamber. For a displacement of the throttle flap 15 from the half-throttle position shown in FIG. 4 to the idle position shown in FIG. 5, the contact tip 60 is in contact with the first control flank 58. In this way, the pump piston 21 is moved in the direction toward the pumping chamber 24. The pump movement leads to the situation that fuel is supplied through the feed line 23 via the main outlet opening 13 into the intake channel section 2. For a movement of the throttle flap 15 from the full-load position into the idle position, fuel is thereby first drawn by suction into the pumping chamber 24 and this fuel is then supplied to the intake channel section 2. For a movement of the throttle flap 15 from the idle position into the full-load position, fuel is inducted into the pumping chamber 24 oppositely via the contact of the contact pin 60 with the first control flank 58. Thereafter, the fuel is injected into the intake channel section 2 when there is a contact of the contact tip 60 with the control flank 59. The control section 57 effects an additional feeding of fuel during acceleration as well as for transitions from the full-load position into the idle position. In this way, an optimal supply of an internal combustion engine with an air/fuel mixture is ensured in each operating state.

Figure 6:
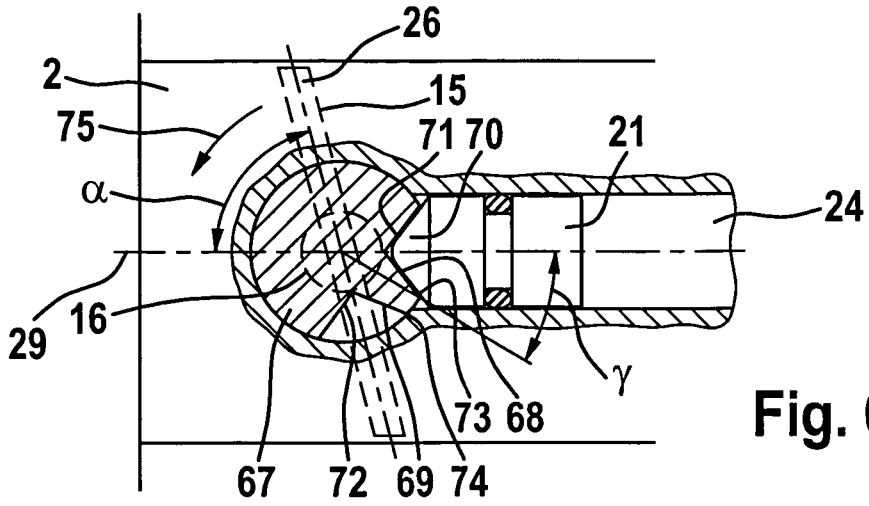
FIG. 6 is a schematic showing a control section with the throttle flap in the idle position.
Figure 7:
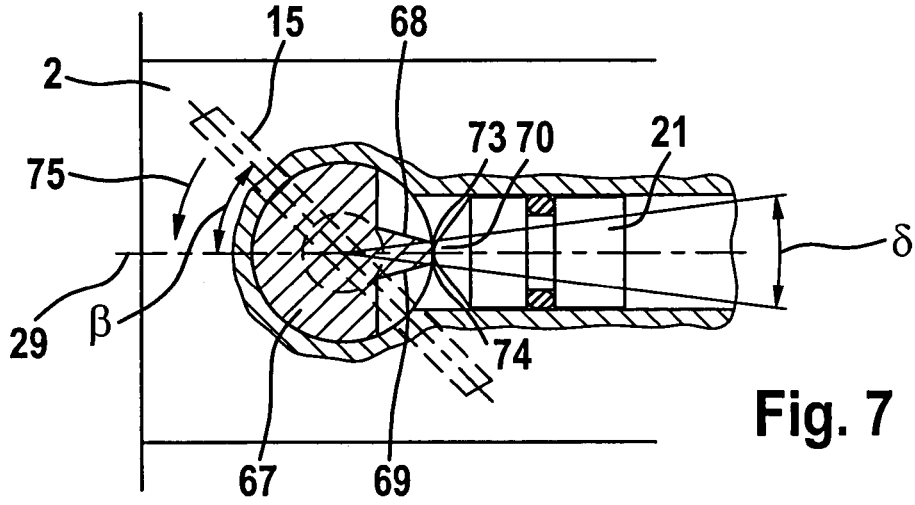
FIG. 7 shows the control section of FIG. 6 with the throttle flap in the half-throttle position; and, FIG. 8 shows the control section of FIG. 6 in the full-load position.
Figure 8:
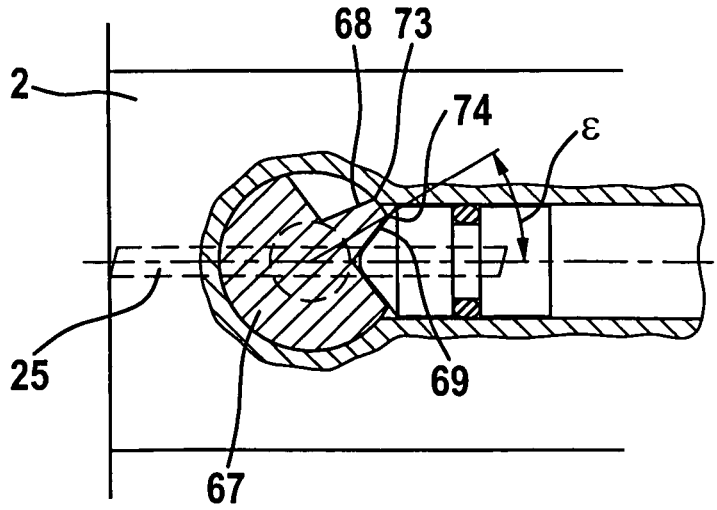

FIGS. 6 to 8 show a further embodiment for a control section 67. The pump piston 21 is shown only schematically. The pump, which is to be utilized with the control section 67, corresponds to the pumps 20 and 30 from the previous FIGS. For the idle position 26 of the throttle flap 15 shown in FIG. 6, the throttle flap 15 and the longitudinal center axis 29 of the intake channel section 2 conjointly define an angle a which is approximately 75°. In this position, the pump piston 21 lies in a first slot 71 on the control section 67. The control section 67 is configured to be essentially circular in shape and has a greater diameter than the throttle shaft 16 indicated in phantom outline in FIG. 6. The control section 67 has a first slot 71 as well as a second slot 72. The slots 71 and 72 have a V-shaped cross section and the opening angles of the slots 71 and 72 correspond essentially to the angle of the rounded contact tip 70 of the pump piston 21.

The first slot 71 has a first control flank 68 with which the contact tip 70 is in contact for a movement of the throttle flap 15 from the idle position 26 shown in FIG. 6 in the direction of the arrow 75. The control flank 68 then extends over an angle $\gamma$ of the circularly-shaped control section 67 which corresponds to approximately 30°. The angle $\gamma$ thereby corresponds to approximately 40% of the displacement path between the idle position and the full-load position. The angle $\gamma$ can advantageously be up to 65% of the displacement path. The control flank 68 passes at corner point 73 into the periphery of the control section 67.

In the half-throttle position of the throttle flap 15 shown in FIG. 7, the contact tip 70 lies against the periphery of the control section 67. Because of the circularly-shaped cross section of the control section 67, the pump piston 21 does not undergo a displacement between the corner point 73 on the first control flank 68 and the corner point 74 on the second control flank 69. The two corner points (73, 74) lie apart from each other by an angle $\delta$ which corresponds to approximately 15°. The angle $\delta$ thereby amounts to approximately 20% of the total displacement path. Values of 5% to 40% are advantageous. The throttle flap 15 and the longitudinal center axis 29 of the intake channel section 2 conjointly define an angle $\beta$ of approximately 35° to 40° in this position.

For a further rotation of the throttle flap 15 in the direction of arrow 75, the contact tip 70 comes into contact with the second control flank 69 at the second slot 72. The second control flank 69 extends over an angle $\epsilon$ of approximately 30°. The angle $\epsilon$ extends thereby over approximately 40% of the total displacement path. Here, values up to 65% of the displacement path are advantageous. In the operation of a carburetor 1 with a pump, whose piston 21 lies against a control flank 67, fuel is first introduced into the intake channel section 2 with a movement of the throttle flap 15 from the full-load position 25 into the idle position 26. This is so because the pump piston 21 is pressed in the direction toward the pumping chamber by the contact with the second control flank 69 and so moves fuel into the intake channel section 2. The fuel is pumped during the first 30° of the rotation of the throttle flap 15 starting from the full-load position. Thereafter, the pump piston 21 does not move for approximately 15° in order to thereafter be pressed away from the pump chamber 24 at the first control flank 68. With this movement, fuel is drawn by suction into the pumping chamber 24. The induction of fuel takes place during the last 30° ahead of reaching the idle position 26. For the movement of the throttle flap 15 in the opposite direction (that is, from the idle position 26 into the full-load position 25), at first, fuel is pumped into the intake channel section 2 by the first control flank 68. In this way, the acceleration of the internal combustion engine is improved. The piston 21 is not moved during the next 15° of the throttle shaft rotation. Thereafter, the stroke of the pump piston 21 takes place away from the pumping chamber 24 because of the second control flank 69 during which stroke fuel is drawn by suction into the pumping chamber 24. This stroke too extends over approximately 30° of the throttle shaft rotation. The arrangement of the two control flanks 68 and 69 thereby makes possible the additional supply of fuel during the acceleration as well as the additional supply of fuel when the engine is run down from the full-load state into the idle state.

The injection duration or the duration of induction into the pumping chamber can be changed in a simple manner by varying the angles $\gamma$, $\delta$ and $\epsilon$ at the control section 67. Corresponding angle changes are also possible for the control section 57 shown in FIGS. 4 and 5. The stroke of the pumping piston 21 can be adjusted over the depth of the first slot and the second slot. With different slot depths, the fuel quantity, which is supplied to the intake channel section during the running down and the fuel quantity, which is supplied during acceleration, can be individually adapted independently of each other. It can also be practical that the throttle flap first passes through a specific displacement distance before the pump piston comes into engagement with a control flank.

It can be practical that the fuel is pumped from the pumping chamber (24, 34) directly into the venturi section or directly into the crankcase of the internal combustion engine.

It is understood that the foregoing description is that of the preferred embodiments of the invention and that various changes and modifications may be made thereto without departing from the spirit and scope of the invention as defined in the appended claims.

What is claimed is:

1. A carburetor for an internal combustion engine including an engine mounted in a portable handheld work apparatus, the carburetor comprising:

a carburetor housing defining an intake channel communicating with the engine;

a throttle element journalled in said intake channel and being adjustable between a full-load position and an idle position;

a pump assembly for supplying additional fuel for said engine;

said pump assembly including a pump chamber and a pump piston guided in said pump chamber;

means for coupling the position of said pump piston to the position of said throttle element so as to cause fuel to be pumped out of said pump chamber and be supplied to said engine when said throttle element is shifted from said full-load position into said idle position;

said coupling means including a control section formed on said throttle element and said pump piston lies against said control section;

said control section including at least one control flank: and, said control flank being in contact engagement with said pump piston over a part range between said idle position and a position of said throttle element whereat said throttle element is displaced from said idle position by up to 65% of the entire displacement path to said full-load position.

2. The carburetor of claim 1, wherein said control flank is in contact engagement with said pump piston over a part range between said idle position and a position of said throttle element whereat said throttle element is displaced from said idle position by up to 40% of the entire displacement path to said full-load position.

3. A carburetor for an internal combustion engine including an engine mounted in a portable handheld work apparatus, the carburetor comprising:

a carburetor housing defining an intake channel communicating with the engine;

a throttle element journalled in said intake channel and being adjustable between a full-load position and an idle position;

a pump assembly for supplying additional fuel for said engine;

said pump assembly including a pump chamber and a pump piston guided in said pump chamber;

means for coupling the position of said pump piston to the position of said throttle element so as to cause fuel to be pumped out of said pump chamber and be supplied to said engine when said throttle element is shifted from said full-load position into said idle position;

said coupling means including a control section formed on said throttle element and said pump piston lies against said control section;

said control section including at least one control flank; and, said control flank being in contact engagement with said pump piston over a part range between said full-load position and a position of said throttle element whereat said throttle element is displaced from said full-load position by up to 65% of the total displacement path to said idle position.

4. The carburetor of claim 3, wherein said control section lies outside of said intake channel.

5. The carburetor of claim 3, wherein said control flank is a first control flank and said coupling means include a second control flank forward on said throttle element; and, said second control flank is in contact engagement with said pump piston over a part range between said full-load position and a position of said throttle element whereat said throttle element is displaced from said full-load position by up to 40% of the total displacement path to said idle position.

6. The carburetor of claim 3, wherein a range of 5% to 40% of the entire displacement path lies between said first and second control flanks wherein said control section effects no displacement of said pump piston.

7. The carburetor of claim 3, wherein a range of approximately 20% of the entire displacement path lies between said first and second control flanks wherein said control section effects no displacement of said pump piston.

8. The carburetor of claim 3, wherein said intake channel defines a longitudinal center axis; and, said control flank is formed as a flat which lies transversely to said longitudinal center axis in said full-load position of said throttle element.

9. The carburetor claim 3, wherein said throttle element comprises a throttle flap and a throttle shaft pivotally journalled in said intake channel.

10. The carburetor of claim 3, further comprising a fuel supply and a fuel line connecting said pump chamber to said fuel supply.

11. The carburetor of claim 10, wherein said carburetor is a membrane carburetor including a control chamber and said fuel supply is said control chamber.

12. The carburetor of claim 10, wherein said carburetor is a membrane carburetor including a control chamber and said fuel line opens into said fuel supply outside of said control chamber.

13. The carburetor of claim 10, further comprising a check valve mounted in said fuel line.

14. The carburetor of claim 3, wherein the fuel is pumped from said pump chamber into said intake channel.

15. The carburetor of claim 14, wherein said pump assembly supplies fuel to said intake channel via an injection line.

16. The carburetor of claim 15, further comprising a fuel outlet opening into said intake channel and a supply line connecting said pump assembly to said outlet opening; and, said pump assembly supplying fuel to said fuel outlet via said supply line.

17. The carburetor of claim 15, further comprising a line connecting said pump assembly to said intake channel; and, a check valve mounted in said line.

* * * * *

UNITED STATES PATENT AND TRADEMARK OFFICE

CERTIFICATE OF CORRECTION

PATENT NO. : 7,000,906 B2
APPLICATION NO. : 10/871058
DATED : February 21, 2006
INVENTOR(S) : Klaus Geyer et al.

It is certified that error appears in the above-identified patent and that said Letters Patent is hereby corrected as shown below:

In column 5:
Line 43: delete "a" and substitute -- α -- therefor.

In column 7:
Line 24: delete "flank:" and substitute -- flank; -- therefor.

Signed and Sealed this

First Day of August, 2006

JON W. DUDAS
*Director of the United States Patent and Trademark Office*